US008754346B2

(12) United States Patent
Harada et al.

(10) Patent No.: US 8,754,346 B2
(45) Date of Patent: Jun. 17, 2014

(54) VACUUM VALVE

(75) Inventors: Takakazu Harada, Tokyo (JP); Takayuki Itotani, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 238 days.

(21) Appl. No.: 13/509,314

(22) PCT Filed: Jun. 16, 2010

(86) PCT No.: PCT/JP2010/060195
§ 371 (c)(1),
(2), (4) Date: May 11, 2012

(87) PCT Pub. No.: WO2011/089741
PCT Pub. Date: Jul. 28, 2011

(65) Prior Publication Data

US 2012/0228265 A1 Sep. 13, 2012

(30) Foreign Application Priority Data

Jan. 20, 2010 (JP) ..... 2010-010154

(51) Int. Cl.
*H01H 3/00* (2006.01)

(52) U.S. Cl.
USPC ..... 218/154; 218/118

(58) Field of Classification Search
USPC ..... 218/118–120, 154
See application file for complete search history.

(56) References Cited

U.S. PATENT DOCUMENTS 5,929,405 A * 7/1999 Wehrli et al. ..... 200/50.01
5,955,716 A * 9/1999 Thuries et al. ..... 218/154
6,653,918 B1 * 11/2003 Johnson ..... 335/68
7,518,076 B1 * 4/2009 Gottschalk et al. ..... 200/400
8,076,598 B2 * 12/2011 Billard et al. ..... 200/50.06
8,203,088 B2 * 6/2012 Gottschalk et al. ..... 200/50.01
2008/0258667 A1 * 10/2008 Morris et al. ..... 318/490

FOREIGN PATENT DOCUMENTS

| | | | |
|---|---|---|---|
| JP | 59-198624 | A | 11/1984 |
| JP | 1-105428 | A | 4/1989 |
| JP | 1-502546 | A | 8/1989 |
| JP | 2-227923 | A | 9/1990 |
| JP | 8-7723 | A | 1/1996 |
| JP | 2004-39432 | A | 2/2004 |
| WO | WO 87/06052 | A1 | 10/1987 |

OTHER PUBLICATIONS

*International Search Report (PCT/ISA/210) issued on Aug. 10, 2010, by the Japanese Patent Office as the International Searching Authority for International Application No. PCT/JP2010/060195.

* cited by examiner

*Primary Examiner* — Truc Nguyen
(74) *Attorney, Agent, or Firm* — Buchanan Ingersoll & Rooney PC

(57) ABSTRACT

A fixed electrode 10 and a movable electrode have coil electrodes formed of plural coil portions installed at both contacts and on a rear surface side in a divided manner in a circumferential direction along peripheries of the contacts such that a longitudinal field is generated in a direction in which the fixed contact and the movable contact come close to and move apart from each other. Protruding portions joined to the contacts are provided to tip ends of the respective coil portions to form joint portions to the respective contacts. A current to be flowed is controlled by changing resistance values between the contacts and the coil electrodes for each joint portion.

6 Claims, 6 Drawing Sheets

VACUUM VALVE

TECHNICAL FIELD

The present invention relates to a vacuum interrupter configured to diffuse an arc using a field generated by a current flowing through electrodes.

BACKGROUND ART

FIG. 8 is a conceptual view showing a configuration of a typical breaker provided with a vacuum interrupter 35. A breaker 30 is provided with an insulating frame 34 housing therein the vacuum interrupter 35 and installed on a carriage 31. The vacuum interrupter 35 has a fixed-side connection conductor 36 connected to a fixed electrode bar, a flexible conductor 37 connected to a movable electrode bar, and a movable-side connection conductor 38. The fixed-side connection conductor 36 and the movable-side connection conductor 38 are introduced to an outside of the insulating frame 34. Installed at a front of the carriage 31 are a face plate 32 and an operation mechanism 33.

A vacuum interrupter adopted in such a breaker includes a bottomed cylindrical vacuum container made of an insulating material, such as a glass material and a ceramic material, and having a highly evacuated interior, electrode bars respectively provided to both end portions of the vacuum container, spiral-ring-shaped coil electrodes provided to opposing end portions of the respective electrode bars, reinforcing members reinforcing contacts, and disc-shaped contacts. A current is passed or interrupted as the both contacts, that is, a fixed contact and a movable contact, are brought into contact with or spaced apart from each other by moving one electrode bar in an axial direction. The coil electrodes referred to herein mean coil electrodes provided with plural arc-shaped coil portions installed to the both contacts on a rear surface side in a divided manner in a circumferential direction along peripheries of the contacts and having an arm portion in the axial direction at one end of a coil and a protruding portion connected to the contacts at the other end so as to generate an axial magnetic field in a direction in which a fixed contact and a movable contact as a main electrode come close to and move apart from each other.

In the vacuum interrupter as above, the coil electrodes generate a field in the axial direction as a current is passed, and a current density is lowered for the contact surface by diffusing an arc between the contacts inevitably generated when the current is interrupted over the contact surfaces while trapping the arc within diameters of the contacts. Accordingly, the contact material outperforms in interruption capability and a current is interrupted.

In the vacuum interrupter that enhances an interruption capability by generating an axial magnetic field, an eddy current is induced at the disc-shaped contact and there is a problem that a field generated by the eddy current weakens the axial magnetic field by the coil electrode. It is known to provide radial slits to the contact to avoid the eddy current. The slits penetrating through the contact, particularly in a vacuum interrupter used in a class of high rated voltage, may possibly become a weak point portion in capability for withstanding high voltage between the opposing contacts. Hence, it is also known to provide a radial groove not penetrating through the contact to the contact on the side of the coil electrode.

When an arc is ignitiond between the fixed contact and the movable contact of the vacuum interrupter when a current is interrupted, a current (arc current) flows through the fixed contact side, that is, through the fixed-side connection conductor connected to the fixed electrode bar and through the movable contact side, that is, through the movable-side connection conductor connected to the movable electrode bar, and an electromagnetic force is generated. The electromagnetic force drives the arc in a direction in which the electromagnetic force acts and thereby moves the arc from the ignition position. As the arc moves, a large part of the current passes through a connection portion at a nearest position in the direction in which the electromagnetic force acts and then flows into the coil portion of this connection portion. In short, the current does not flow homogeneously to the respective coil portions forming the coil electrode. Accordingly, a field generated in a coil portion in which a larger amount of the current (a large part of the current) flows becomes stronger than fields generated in the other coil portions. On the contrary, because an arc has a characteristic of spreading in a region where the axial magnetic field strength is strong at or higher than a given value, an arc diffuses along a region (extending region) extending along the circumferential direction of a coil portion through which a larger amount of the current flows.

However, in a normal coil electrode, plural coil portions are merely provided in a divided manner at equal length. Consequently, an arc intensifies in a relatively narrow area along the extending region of one of the equally divided coil portions. This raises a problem that the main electrode (contact) is damaged or consumed significantly due to local overheating and an interruption capability is deteriorated by overheating. It is therefore known to make a coil portion at a particular point longer than the other coil portions instead of the coil portions having an equally divided length.

RELATED ART DOCUMENTS

Patent Documents

Patent Document 1: JP-T-1-502546, FIG. 2

Patent Document 2: JP-A-2004-39432, FIG. 1

The term, "JP-T", referred to herein means a published Japanese translation of a PCT patent application.

SUMMARY OF THE INVENTION

Problems that the Invention is to Solve

With the vacuum interrupter in the related art, in order to obtain electrodes satisfying enhancement of an interruption capability and enhancement of a capability for withstanding high voltage at the same time, it is necessary to provide a groove to a contact so as not to penetrate through the contact by mechanical processing and further to form a coil electrode of a particular shape. In particular, it is necessary to design a coil electrode of a particular shape by giving considerations to influences of an electromagnetic force by an outside connection terminal in a breaker assembled state. Because this is an exclusive design, in a case where the vacuum interrupter is manufactured by combining forging and mechanical processing for a cost saving, many forging dies are required depending on specifications, such as an interruption current value, and a combination with a breaker. Hence, the coil electrodes have to be manufactured by a high-mix low-volume lot, which increases the price relatively high.

The invention has an object to provide a vacuum interrupter that solves the problems above and can be provided at a low cost in a simple shape while satisfying enhancement of the interruption capability and enhancement of the capability for withstanding high voltage at the same time using electrodes that generate an axial magnetic field.

Means for Solving the Problems

A vacuum interrupter of the invention is provided with a fixed electrode and a movable electrode each having a contact and installed in a vacuum container in such a manner so as to allow both contacts to come close to and move apart from each other. The fixed electrode and the movable electrode each have a coil electrode formed of plural coil portions installed to each contact on a rear surface side in a divided manner in a circumferential direction along a periphery of the contact so that a longitudinal field is generated in a direction in which the both contacts come close to and move apart from each other. Protruding portions joined to the contacts are provided to tip ends of the respective coil portions to form joint portions to the respective contacts. A current to be flowed is controlled by changing a resistance value between a center portion of each contact and the corresponding coil electrode for each joint portion, so that an axial magnetic field distribution generated between the both electrodes is controlled.

Advantage of the Invention

As has been described above, by controlling respective currents flowing through the plural the coil portions of the coil electrodes provided to the fixed contact and the movable contact on the rear surface side, the invention simultaneously achieves three objects: to make it possible to diffuse an arc homogeneously across the entire contact surfaces; to form no weak point portion in capability for withstanding high voltage in each contact on the surface opposing the other; and to control eddy currents in the contacts that weaken an axial magnetic field developed by the coil electrodes. Consequently, not only does it become possible to achieve enhancement of the interruption capability and enhancement of the capability for withstanding high voltage, but it also becomes possible to provide a vacuum interrupter manufactured at low costs in a simple shape.

MODE FOR CARRYING OUT THE INVENTION

First Embodiment

Figure 1:
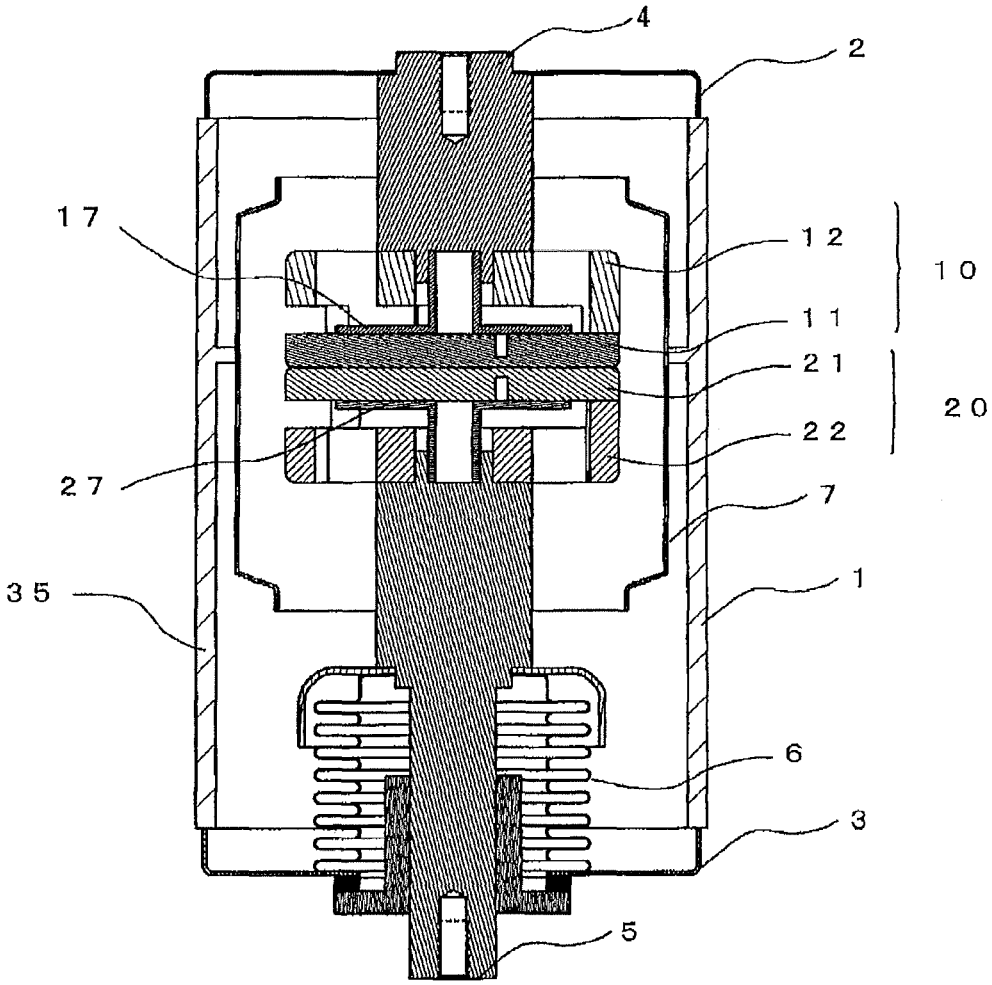
FIG. 1 is a cross section of a vacuum interrupter according to a first embodiment of the invention.
Figure 2:
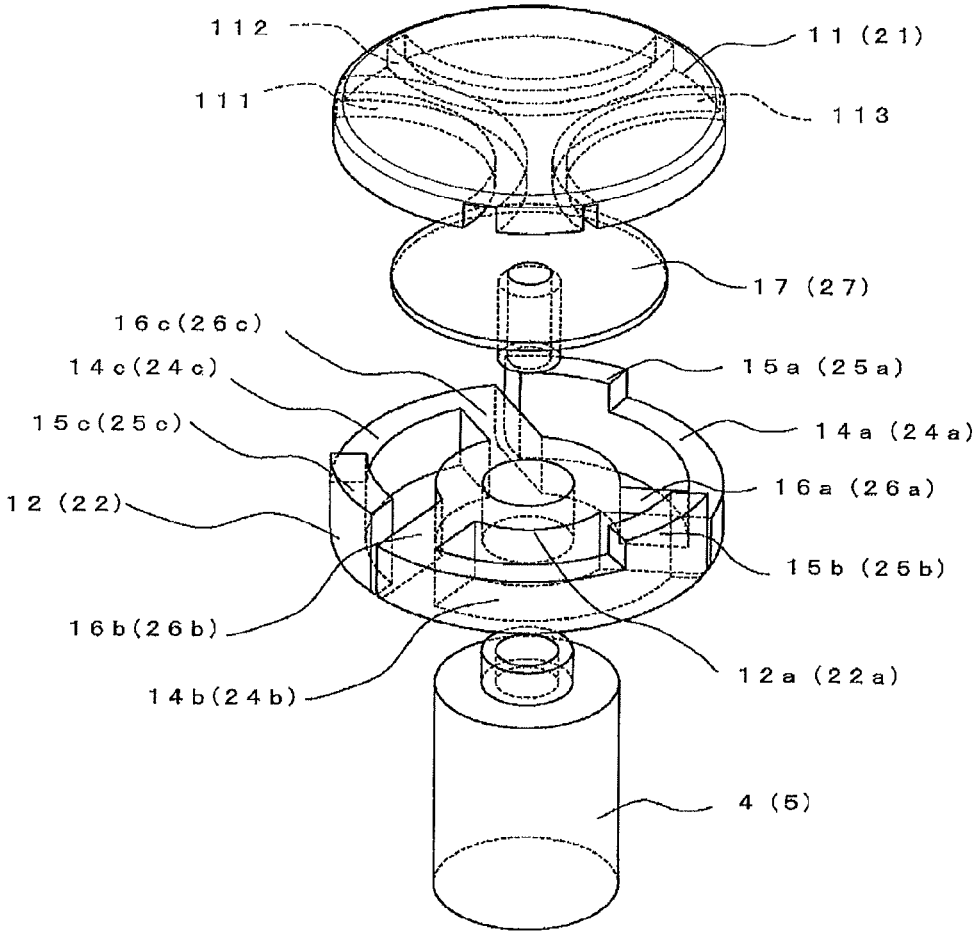
FIG. 2 is an exploded perspective view used to describe a configuration of a fixed electrode of the vacuum interrupter of the first embodiment.
Figure 3:
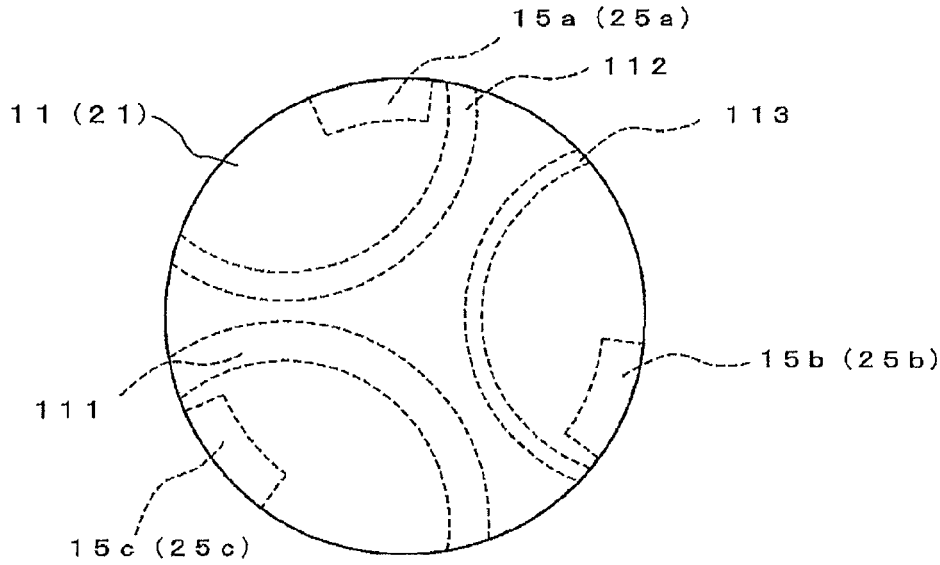
FIG. 3 is a plan view of a fixed contact of the first embodiment.

FIG. 1 is a cross section of a vacuum interrupter of a first embodiment. FIG. 2 is an exploded perspective view used to describe a configuration of a fixed electrode of the first embodiment. FIG. 3 is a plan view of a fixed contact of the first embodiment. Referring to the drawings, a vacuum interrupter 35 of the invention includes an insulating cylinder 1 made of alumina ceramic or the like, a fixed-side end plate 2 covering one end opening portion of the insulating cylinder 1, and a movable-side endplate 3 covering the other end opening portion of the insulting cylinder 1, and forms a vacuum container. The fixed-side and movable-side end plates 2 and 3 are attached to respective end faces of the insulting cylinder 1 by brazing. A fixed electrode bar 4 is joined to the fixed-side end plate 2 at a center portion by brazing and a fixed electrode 10 is joined to a tip end of the fixed electrode bar 4 by brazing. A movable electrode 20 is provided oppositely to the fixed electrode 10 and the movable electrode 20 is joined to a movable electrode bar 5 by brazing. Further, the movable electrode bar 5 is joined by brazing to one end of a bellows 6 of an accordion shape made, for example, of thin stainless and provided so as to allow the movable electrode bar 5 to move while maintaining a vacuum tight condition. The other end of the bellows 6 is joined to the movable-side end plate 3 and the movable electrode bar 5 is provided to protrude from a center portion of the movable-side end plate 3. Owing to the bellows 6, the movable electrode bar 5 is allowed to move in a top-bottom direction of the drawing and the fixed electrode 10 and the movable electrode 20 are allowed to come close to and move apart from each other in the insulating container maintained under a vacuum tight condition.

An arc shield 7 is supported and fixed onto the insulating cylinder 1 so as to surround a periphery of the fixed electrode 10 and the movable electrode 20. The arc shield 7 is used to suppress metal vapor caused by an arc generated between the electrodes when a current is interrupted in an amount adhering to an inner surface of the insulating cylinder 1.

The fixed electrode 10 and the movable electrode 20 of FIG. 1 are formed in such a manner that an axial magnetic field is generated between the electrodes when a current is interrupted and a structure thereof will be described in detail with reference to FIG. 2. Because the fixed electrode 10 and the movable electrode 20 are of the same configuration, a description will be given to the fixed electrode 10 with reference to reference numerals and a description of the movable electrode 20 is omitted by adding numeral references in parentheses after reference numerals of the fixed electrode unless otherwise necessary.

Figure 8:
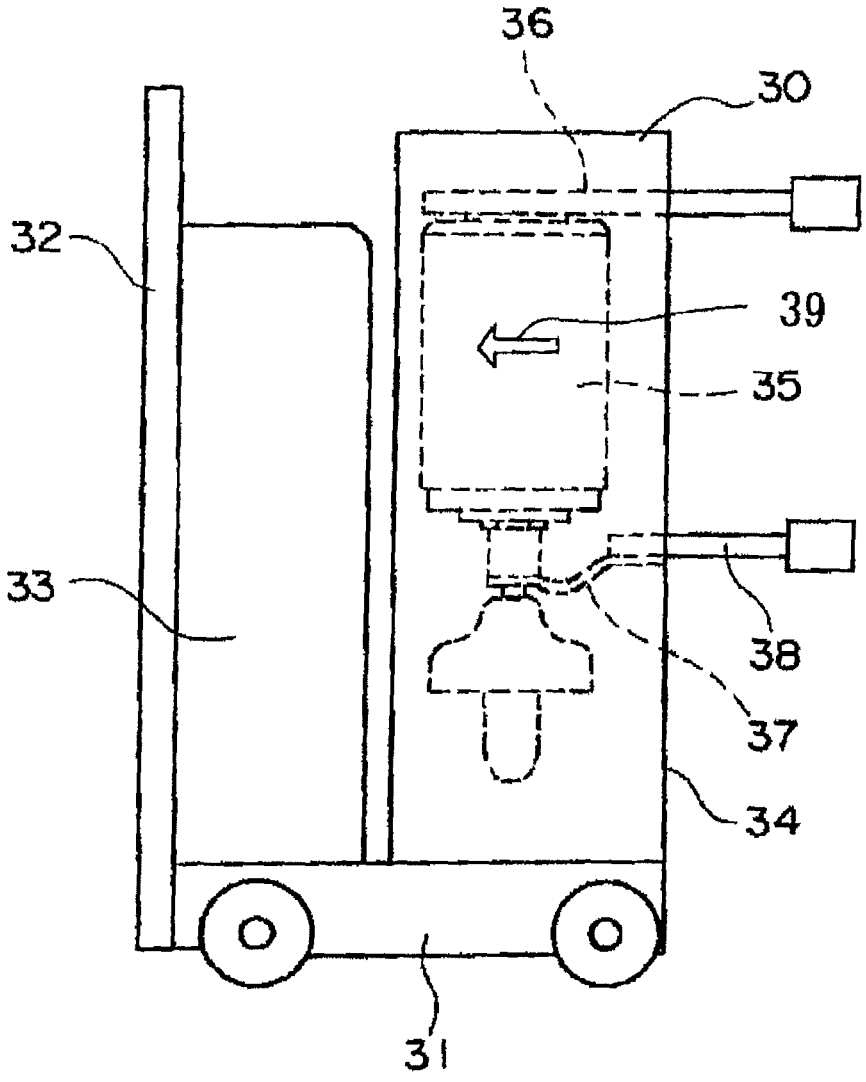
FIG. 8 is a conceptual view showing a configuration of a typical breaker provided with a vacuum interrupter.

The fixed electrode 10 (movable electrode 20) is formed of the disc-shaped fixed contact 11 (21) as a main electrode, a fixed coil electrode 12 (22) provided to the fixed contact 11 (21) on a rear surface side so as to generate an axial magnetic field in a direction in which the unillustrated movable contact 21 comes close to and moves apart from the fixed contact 11, the supporting member 17 (27) made of a high-resistance material, such as stainless steel, and mechanically supporting the fixed contact 11 (21) and the fixed coil electrode 12 (22), and the fixed electrode bar 4 (5) to which the fixed coil electrode 12 (22) together with the fixed contact 11 (21) is attached. As is shown in FIG. 8, a fixed-side connection conductor 36, a flexible conductor 37, and a movable-side connection conductor 38 are connected to the fixed electrode bar 4 and the movable electrode bar 5 from the outside of the vacuum interrupter 35. It is preferable that the fixed contact 11 (movable contact 21) is made of silver alloy, copper alloy, or the like.

The fixed coil electrode 12 (movable coil electrode 22) is formed of a ring portion 12*a* (22*a*) serving as abase portion provided continuously to the fixed electrode bar 4 (5), three arc-shaped coil portions as field generating coils provided so as to extend on a circumference along an outer rim of the ring portion 12*a* (22*a*) respectively at equally divided three positions, that is, a first coil portion 14*a* (24*a*), a second coil portion 14*b* (24*b*), and a third coil portion 14*c* (24*c*), and armportions 16*a*, 16*b*, and 16*c* (26*a*, 26*b*, and 26*c*) extending radially from the ring portion 12*a* (22*a*) to continuously join one ends of the respective coil portions to the ring portion 12*a* (22*a*). Hereinafter, the first coil portion 14*a* (24*a*), the second coil portion 14*b* (24*b*), and the third coil portion 14*c* (24*c*) are referred to also collectively as the coil portions 14 (24). Likewise, the arm portions 16*a*, 16*b*, and 16*c* (26*a*, 26*b*, and 26*c*) are referred to also collectively as the arm portions 16 (26).

Connection portions 15*a*, 15*b*, and 15*c* (25*a*, 25*b*, and 25*c*) are provided to protrude at tip ends of free ends of the respective coil portions 14 (24) so as to be in contact with the rear surface of the fixed contact 11 (movable contact 21). Hereinafter, the connection portions 15*a*, 15*b*, and 15*c* (25*a*, 25*b*, and 25*c*) are referred to also collectively as the connection portions 15 (25). The respective connection portions 15 (25) are joined to the fixed contact 11 (21) on the rear surface side by brazing and combined with the fixed contact 11 (21) into one piece. In this manner, the fixed coil electrode 12 and the movable coil electrode 22 are provided, respectively, to the fixed contact 11 and the movable contact 21 as the main electrodes on the rear surface side by the coil portions 14 (24) as plural field generating coils provided in an arc shape on the circumference about an axis set in a direction in which the both contacts 11 and 21 come close to and move apart from each other with equally divided coil lengths.

As is shown in FIG. 3, the fixed contact 11 (21) is provided with grooves 111, 112, and 113 on the rear surfaces so as to surround joint portions to the fixed coil electrode 12 (movable coil electrode 22). The joint portions referred to herein mean portions in which the connection portions 15 (25) of the fixed coil electrode 12 (movable coil electrode 22) are joined to the fixed contact 11 (21). Different from slits, the grooves 111, 112, and 113 are of a shape that does not penetrate through the fixed contact 11 (21). In the first embodiment, the groove 111, the groove 112, and the groove 113 have the same groove depth and different groove widths. The groove widths decrease, for example, in order of the groove 111, the groove 112, and the groove 113.

In the vacuum interrupter having the electrodes configured as above, an arc current flowed to center portions of the fixed contact 11 and the movable contact 21 flows to the respective joint portions of the coil electrode 12 (22) by passing through the contact cross section. However, a resistance ratio of resistance values to the respective joint portions when viewed from the center portion of the fixed contact 11 (21) varies due to a difference of the groove widths of the grooves 111, 112, and 113, and a current flowing through the connection portion 15*c* (25*c*) surrounded by the groove 111 having the largest groove width becomes the smallest. Hence, a current flowing through the third coil portion 14*c* (24*c*) and the arm portion 16*c* (26*c*) continued thereto becomes smaller than the others. Accordingly, strength of an axial magnetic field generated in this coil portion 14*c* (24*c*) becomes weaker than those in the other coil portions.

However, as is shown in FIG. 8, immediately after the arc is generated, an electromagnetic force starts to act thereon in a direction indicated by an arrow 39 by a current path formed in a U shape by the fixed-side connection conductor 36, the vacuum interrupter 35, and the movable-side connection conductor 38 of the breaker. This gives adverse effects to diffusion of the arc across the entire contact surface. However, by providing the coil portion 14*c* continued to the connection portion 15*c* surrounded by the groove 111 on a side to which the arc readily diffuse, currents flowing through the coil portions 14*a* and 14*b* located on a side to which the arc hardly diffuses are increased. Consequently, strength of the axial magnetic fields generated in the coils 14*a* and 14*b* becomes higher and it becomes possible to diffuse the arc homogeneously across the entire surface of the fixed contact 11 (21). In addition, because the grooves 111, 112, and 113 act as resistances to suppress an eddy current flowing through the fixed contact 11 (21), it becomes possible to reduce influences such that weaken the axial magnetic fields. Further, because the grooves 111, 112, and 113 do not penetrate through the fixed contact 11 (21), it is configured in such a manner that no portion that becomes a weak point in capability for withstanding high voltage is formed in the fixed contact 11 on the surface opposing the movable contact 21.

The first embodiment has described a case where the coil electrode is divided by three and the grooves provided to the fixed contact 11 (21) at three points are all different. It should be appreciated, however, that the dividing number of the coil can be changed arbitrarily to a required number depending on an interrupting current value or adjustments with the breaker and the number of differences among the grooves in the contact can be changed arbitrarily. Also, shapes of the grooves may be different in groove depth instead of groove width and further both of the groove widths and the groove depths may be different. In short, the grooves can be different in any manner as long as resistance values of the paths from the fixed contact 11 (21) to the fixed coil electrode 12 (22) can be controlled.

In the first embodiment, it is made possible to diffuse an arc homogeneously across the entire surface of the contact 11 (21) by providing the grooves 111, 112, and 113 controlling currents flowing through the respective coil portions of the coil electrode and controlling an eddy current flowing through the contact 11 (21) to the rear surfaces of the fixed contact 11 and the movable contact 21. Consequently, an interruption capability is enhanced. Further, because the grooves 111, 112, and 113 do not penetrate through the fixed contact 11 (21), no portion that becomes a weak point in capability for withstanding high voltage is formed in the fixed contact 11 on the surface opposing the movable contact 21. Hence, the capability for withstanding high voltage is enhanced at the same time. A configuration satisfying enhancement of the interruption capability and enhancement of the capability for withstanding high voltage at the same time is achieved by providing grooves to the rear surfaces of the contacts. It thus becomes possible to provide inexpensive and versatile electrodes, that is, electrodes readily adaptable to substantially all conditions, and a vacuum interrupter using these electrodes.

Second Embodiment

Figure 4:
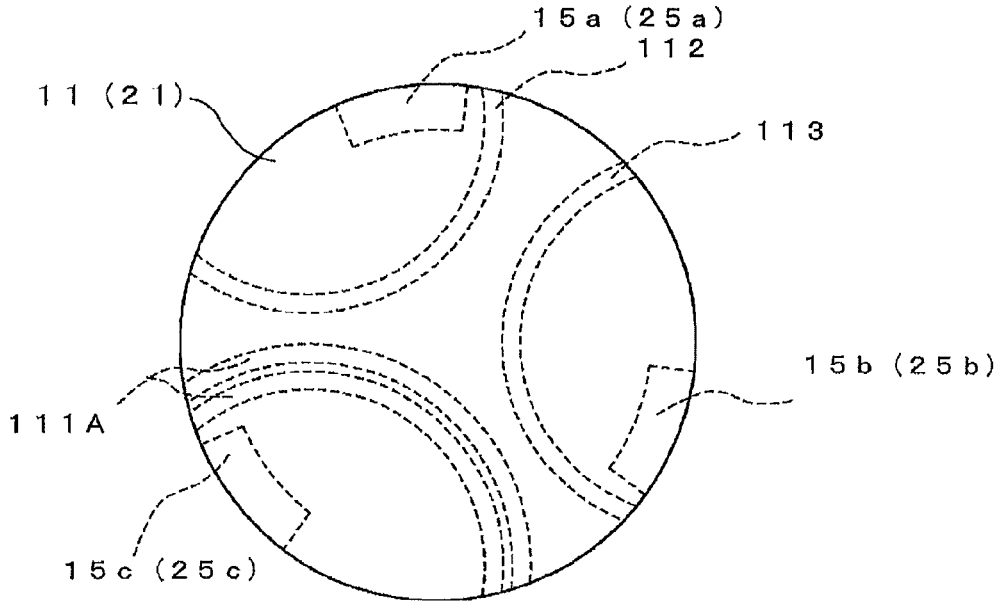
FIG. 4 is a plan view of a fixed contact of a vacuum interrupter according to a second embodiment of the invention.

FIG. 4 is a plan view of a fixed contact of a vacuum interrupter of a second embodiment. Because the vacuum interrupter is of the same configuration as the counterpart of the first embodiment above, a description thereof is omitted and a description will be given to a fixed contact (movable contact) alone herein. As is shown in FIG. 4, grooves 111A, 112, and 113 are provided to a rear surface of a fixed contact 11 (movable contact 21) so as to surround joint portions to a fixed coil electrode 12 (movable coil electrode 22). The joint portions referred to herein mean portions in which connection portions 15 (25) of the fixed coil electrode 12 (22) and the fixed contact 11 (21) are joined to each other. Also, the grooves 111A, 112, and 113 are of a shape that does not penetrate through the fixed contact 11 (21). The groove 111A is formed of grooves in two rows parallel to each other at a predetermined interval. Each of the grooves 112 and 113 is a single-row groove, and a groove width and a groove depth of one row are all the same in the grooves 111A, 112, and 113.

In the vacuum interrupter having the electrodes as above, a resistance value of the joint portion of the connection portion 15*c* surrounded by the groove 111A when viewed from the contact center portion becomes higher than those of the joint portions surrounded by the other grooves. Hence, a current flowing through the connection portion 15*c* (25*c*) of the fixed coil electrode 12 (22) joined to the fixed contact 11 (21) in a portion surrounded by the groove 111A and through the coil portion 14*c* (24*c*) and the arm portion 16*c* (26*c*) continued thereto becomes smaller than the others. Accordingly, strength of an axial magnetic field generated in this coil portion 14*c* (24*c*) becomes weaker than those in the other coil portions. Other functions and advantages are the same as those of the first embodiment above and a description thereof is omitted herein.

The second embodiment has described a case where the coil electrode is divided by three and only one of the grooves provided to the contact is different. It should be appreciated, however, that the dividing number of the coil can be changed arbitrarily to a required number depending on an interrupting current value or adjustments with the breaker and the number of the grooves in the contact can be changed arbitrarily, too. Also, a shape of the groove may be changed from one place to another.

In the second embodiment, it is made possible to diffuse an arc homogeneously across the entire surface of the contact 11 (21) by providing the grooves 111A, 112, and 113 used to control currents flowing through the respective coil portions 14 (24) of the fixed coil electrode 12 (22) and to control an eddy current flowing through the contact 11 (21) to the rear surface of the fixed contact 11 (21). Hence, an interruption capability is enhanced. Further, because the grooves 111A, 112, and 113 do not penetrate through the fixed contact 11 (21), no portion that becomes a weak point in capability for withstanding high voltage is formed in the fixed contact 11 on the surface opposing the movable contact 21. Accordingly, the capability for withstanding high voltage is enhanced at the same time. A configuration satisfying enhancement of the interruption capability and enhancement of the capability for withstanding high voltage at the same time is achieved by providing grooves to the rear surfaces of the contacts. It thus becomes possible to provide inexpensive and versatile electrodes, that is, electrodes readily adaptable to substantially all conditions, and a vacuum interrupter using these electrodes.

Third Embodiment

Figure 5:
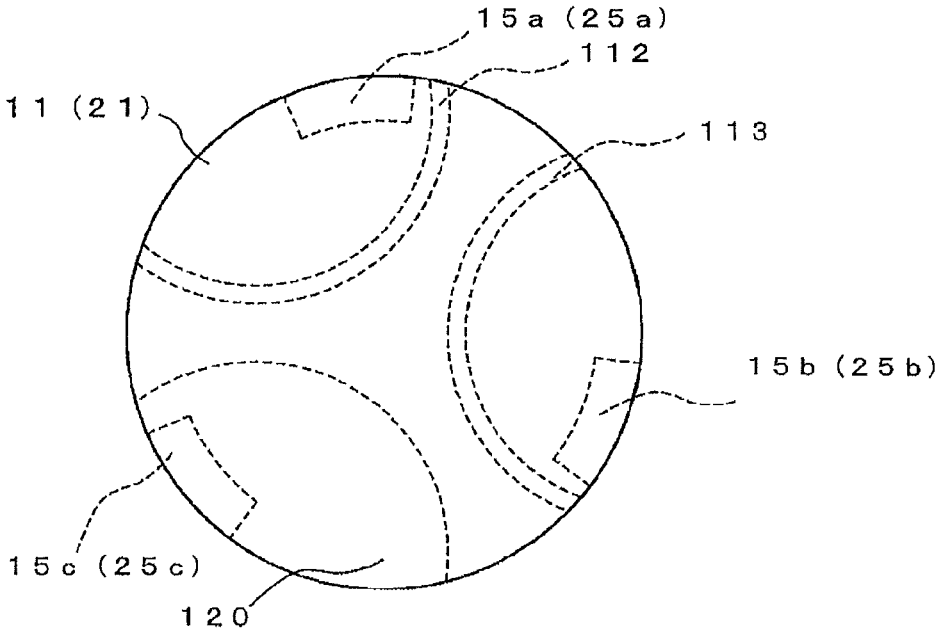
FIG. 5 is a plan view of a fixed contact of a vacuum interrupter according to a third embodiment of the invention.

FIG. 5 is a plan view of a fixed contact of a vacuum interrupter of a third embodiment. Because the vacuum interrupter is of the same configuration as the counterpart of the first embodiment above, a description thereof is omitted and a description will be given to a fixed contact (movable contact) alone herein. Arc-shaped grooves 112 and 113 are provided to the rear surface of the fixed contact 11 (21) so as to surround joint portions to a fixed coil electrode 12 (22). Further, a joint portion at another point is provided to a thin portion 120 obtained by making the rear surface of the fixed contact 11 (21) thin from a periphery along an arc-shaped outline. The joint portions referred to herein mean portions in which connection portions 15 (25) of the fixed coil electrode 12 (22) and the fixed contact 11 (21) are joined to each other. A connection portion 15*c* (25*c*) joined to the thin portion 120 is formed to protrude more than the other two connection portions 15*a* and 15*b* (25*a* and 25*b*) to be joined to the fixed contact 11 (21). A depth of the grooves 112 and 113 may be the same as or different from that of the thin portion 120. It should be noted, however, that the grooves 112 and 113 are formed so as not to penetrate through the fixed contact 11 (21). In the third embodiment, the number of rows forming each of the grooves 112 and 113 is one and the both grooves are of the same configuration.

In the vacuum interrupter having the electrodes configured as above, by adjusting a thickness of the thin portion 120 to make a resistance value larger than those in the other joint portions, a current flowing through the connection portion 15*c* (25*c*) of the fixed coil electrode 12 (22) joined to the fixed contact 11 (21) in the thin portion 120 and through the coil portion 14*c* (24*c*) and the arm portion 16*c* (26*c*) continued thereto becomes smaller than the others. Accordingly, strength of an axial magnetic field generated in this coil portion 14*c* (24*c*) becomes weaker than those in the other coil portions. Other functions and advantages are the same as those of the first embodiment above.

The third embodiment has described a case where the coil electrode is divided by three. It should be appreciated, however, that the dividing number of the coil can be changed arbitrarily to a required number and the number of the grooves in the contact 11 (21) can be changed arbitrarily, too. Further, a thickness of the thin portion 120 can be set arbitrarily. In addition, a shape of the groove may be changed arbitrarily as in the first embodiment above and an outline of the thin portion 120 can be changed arbitrarily, too.

In the third embodiment, it is made possible to diffuse an arc homogeneously across the entire surface of the contact (21) by providing the contact thin portion 120 used to control currents flowing through the respective coil portions 14 (24) of the fixed coil electrode 12 (22) and the grooves 112 and 113 used to control an eddy current flowing through the contact 11 (21) to the rear surfaces of the fixed contact and the movable contact 21. Hence, an interruption capability is enhanced. Further, because the grooves 112 and 113 do not penetrate through the fixed contact 11 (21), no portion that becomes a weak point in capability for withstanding high voltage is formed in the fixed contact 11 on the surface opposing the movable contact 21. Hence, the capability for withstanding high voltage is enhanced at the same time. A configuration satisfying enhancement of the interruption capability and enhancement of the capability for withstanding high voltage at the same time is achieved by providing the grooves 112 and 113 and the thin portion 120 on the rear surface of the contact 11 (21). It thus becomes possible to provide inexpensive and versatile electrodes, that is, electrodes readily adaptable to substantially all conditions, and a vacuum interrupter using these electrodes. In particular, a range of the current value controlled by the current control by the contact thin portion 120 can be broadened.

Fourth Embodiment

Figure 6:
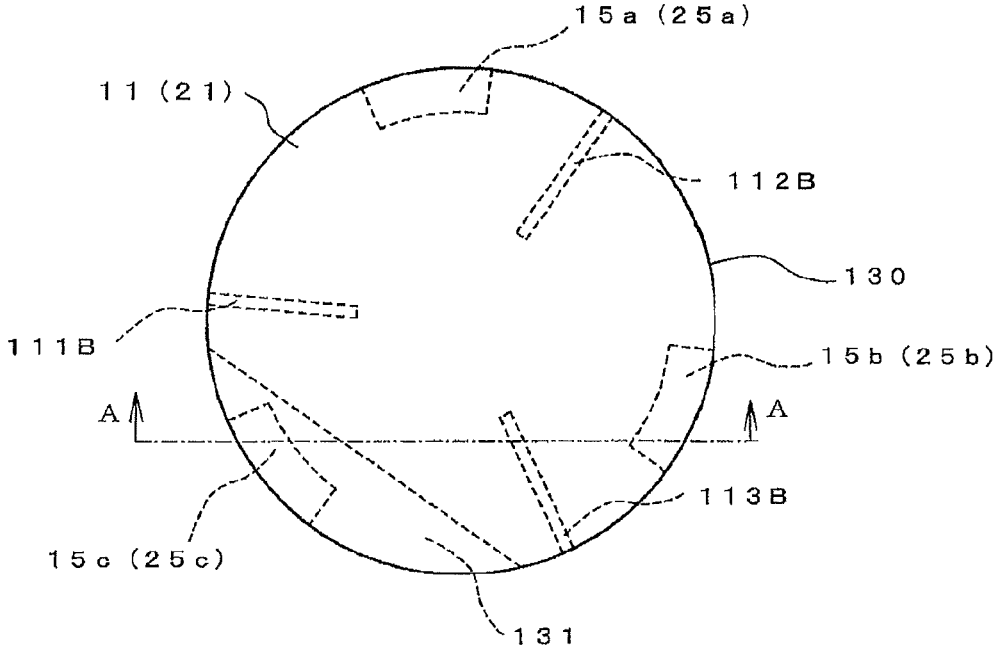
FIG. 6 is a plan view of a region where an oxygen-free copper plate is joined to a fixed contact according to a fourth embodiment of the invention.
Figure 7:
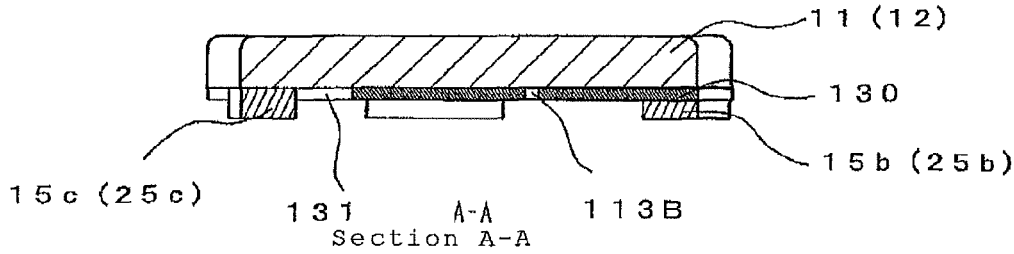
FIG. 7 is a cross section taken on line A-A of FIG. 6.

FIG. 6 and FIG. 7 are views showing a state where a fixed (movable) contact (hereinafter, referred to simply as the contact) and a plate made of a material having better electric conductivity than the contact, for example, an oxygen-free copper plate are joined to each other. Because the vacuum interrupter is of the same configuration as the counterpart of the first embodiment above, a description thereof is omitted and a description will be given herein only to a region in which the contact and the oxygen-free copper plate are joined to each other. An oxygen-free copper plate 130 is joined to the fixed contact 11 (movable contact 21) on a rear surface side.

Regarding a shape of the oxygen-free copper plate 130, a part of an arc is cut off and there are linear slits 111B, 112B, and 113B cut into radially from a circumference to partition respective joint portions to the coil electrode 12 (22). The oxygen-free copper plate 130 processed in this manner is joined to the rear surface of the fixed contact 11 (21). Then, as are shown in FIG. 6 and FIG. 7, a connection portion 15*c* (25*c*) of the coil electrode is directly joined to the rear surface of the fixed contact 11 (21) in the cut-off portion (notch portion 131) and the other connection portions 15*a* (25*a*) and 15*b* (25*b*) are joined to the fixed contact 11 (21) via the oxygen-free copper plate 130. It should be noted that the shape of the slits 111B, 112B, and 113B provided to the oxygen-free copper plate 130 is not limited to a linear shape and grooves may be provided instead of the slits.

In the vacuum interrupter having the electrodes configured as above, because a current actively flows into the oxygen-free copper plate 130 having higher electric conductivity than the fixed contact 11 (21), the oxygen-free copper plate 130 has the notch portion 131. Herein, resistance of the joint portion connecting the connection portion 15*c* (25*c*) of the fixed coil electrode 12 (22) directly to the fixed contact 11 (21) is larger than those in the other joint portions. Hence, a current flowing through the connection portion 15*c* (25*c*) of the fixed coil electrode 12 (22) joined directly to the fixed contact 11 (21) in the notch portion 131 of the oxygen-free copper plate 130 and through the coil portion 14*c* (24*c*) and the arm portion 16*c* (26*c*) continued thereto becomes smaller than the others. Accordingly, strength of an axial magnetic field generated in this coil portion 14*c* (24*c*) becomes weaker than those in the other coil portions. Other functions and advantages are same as those of the first embodiment above. It should be appreciated that the number and the shape of the notch portion 131 of the oxygen-free copper plate 130 and the number and the shape of grooves or slits can be changed arbitrarily.

In the fourth embodiment, it is made possible to diffuse an arc homogeneously across the entire surface of the contact 11 (21) by providing the notch portion 131 of the oxygen-free copper plate 130 used to control currents flowing through the respective coil portions 14 (24) of the fixed coil electrode 12 (22) and the slits 111B, 112B, and 113B or grooves to suppress an eddy current flowing through the contact 11 (21) to the rear surface of the fixed contact 11 (21). Hence, an interruption capability is enhanced. Further, because the oxygen-free copper plate 130 is joined to the rear surface of the contact 11 (21), no portion that becomes a weak point in capability for withstanding high voltage is generated in the fixed contact 11 on the surface opposing the movable contact 21. Hence, the capability for withstanding high voltage is enhanced at the same time. A configuration satisfying enhancement of the interruption capability and enhancement of the capability for withstanding high voltage at the same time is achieved by the oxygen-free copper plate 130 joined to the rear surface of the contact 11 (21). It thus becomes possible to provide inexpensive and versatile electrodes and a vacuum interrupter using these electrodes. In particular, it becomes possible to manufacture the oxygen-free copper plate 130 by pressing when the oxygen-free copper plate 130 is of a shape having the notch portion 131 and the slits 111B, 112B, and 113B and a plate thickness of 4 mm or less. Accordingly, more inexpensive electrodes can be manufactured. It should be appreciated that the oxygen-free copper plate 130 is a mere example of a material having higher electric conductivity than the fixed contact 11 (21). It goes without saying that the same advantages can be achieved when another material having high electric conductivity, for example, a conductive plate, such as copper alloy having high electric conductivity, is used as an alternative.

DESCRIPTION OF SIGNS AND REFERENCE NUMERALS

1: insulating cylinder
2: fixed-side end plate,
3: movable-side end plate
4: fixed electrode bar,
5: movable electrode bar
6: bellows,
7: arc shield
10: fixed electrode,
11: fixed contact,
12: fixed coil electrode,
12*a*: fixed coil electrode ring portion,
14: fixed coil electrode coil portion,
14*a*: fixed coil electrode first coil portion,
14*b*: fixed coil electrode second coil portion,
14*c*: fixed coil electrode third coil portion,
15: fixed coil electrode connection portion,
15*a*: fixed coil electrode first connection portion,
15*b*: fixed coil electrode second connection portion,
15*c*: fixed coil electrode third connection portion,
16: fixed coil electrode arm portion,
16*a*: fixed coil electrode first arm portion,
16*b*: fixed coil electrode second arm portion,
16*c*: fixed coil electrode third arm portion,
17: fixed supporting member,
20: movable electrode
21: movable contact
22: movable coil electrode
22*a*: movable coil electrode ring portion
24: movable coil electrode coil portion
24*a*: movable coil electrode first coil portion
24*b*: movable coil electrode second coil portion
24*c*: movable coil electrode third coil portion
25: movable coil electrode connection portion
25*a*: movable coil electrode first connection portion
25*b*: movable coil electrode second connection portion
25*c*: movable coil electrode third connection portion
26: movable coil electrode arm portion
26*a*: movable coil electrode first arm portion
26*b*: movable coil electrode second arm portion
26*c*: movable coil electrode third arm portion
27: movable supporting member
31: carriage
32: face plate
33: operation mechanism
34: insulating frame
35: vacuum interrupter
36: fixed-side connection conductor
37 and 38: movable-side connection conductors
111, 112, and 113: contact grooves
120: contact thin portion
130: oxygen-free copper plate
131: oxygen-free copper plate notch portion

The invention claimed is:

1. A vacuum interrupter provided with a fixed electrode and a movable electrode each having a contact and installed in a vacuum container in such a manner so as to allow both contacts to come close to and move apart from each other, the fixed electrode and the movable electrode each having a coil electrode formed of a plurality of coil portions installed to each contact on a rear surface side in a divided manner in a circumferential direction along a periphery of the contact so that a longitudinal field is generated in a direction in which the both contacts come close to and move apart from each other, the vacuum interrupter being characterized in that:

protruding portions joined to the contacts are provided to tip ends of the respective coil portions to form joint portions to the respective contacts; and a current to be flowed is controlled by changing a resistance value between a center portion of each contact and the corresponding coil electrode for each joint portion, so that an axial magnetic field distribution generated between the both electrodes is controlled.

2. The vacuum interrupter according to claim 1, characterized in that:

grooves are provided to a rear surface of each contact in a vicinity of the joint portions of the contact and the corresponding coil electrode so as to surround the respective joint portions; and the current flowing between the center portion of the contact and the coil electrode is controlled for each joint portion by the grooves.

3. The vacuum interrupter according to claim 2, characterized in that:

at least one of the grooves is different from the other grooves in groove width or groove depth.

4. The vacuum interrupter according to claim 2, characterized in that:

at least one of the grooves is formed of a groove in a plurality of rows substantially parallel to each other.

5. The vacuum interrupter according to claim 1, characterized in that:

a thin portion is provided on a side of each contact in a vicinity of at least one joint portion of the contact and the corresponding coil electrode and grooves are provided so as to surround the other respective joint portions; and the current flowing through the center portion of the contact and the coil electrode is controlled for each joint portion by the thin portion and the grooves.

6. The vacuum interrupter according to claim 1, characterized in that:

a conductive plate made of a material having better electric conductivity than a material of the contacts is joined to each contact on a side of the corresponding coil electrode;

the conductive plate is of a shape having a notch portion in part;

the coil electrode is formed in such a manner that the coil electrode is directly joined to the contact by locating at least one of the joint portions in the notch portion;

the other joint portions are formed in such a manner that the coil electrode is joined to the contact via the conductive plate;

a current flowing between the contact and the coil electrode is controlled by the notch portion; and the conductive plate is provided with slits or grooves that partition the respective joint portions.

* * * * *